United States Patent [19]

Boyd et al.

[11] Patent Number: 4,768,253

[45] Date of Patent: Sep. 6, 1988

[54] SLEEPER SOFA MATTRESS

[76] Inventors: William A. Boyd, Rt. 1, Box 180A, Saltillo, Miss. 38866; William F. Hodges, P.O. Box 2769, Tupelo, Miss. 38803-2769

[21] Appl. No.: 915,616

[22] Filed: Oct. 6, 1986

[51] Int. Cl.[4] ..... A47C 27/05; A47C 27/20

[52] U.S. Cl. ..... 5/464; 5/465; 5/13; 5/478; 5/481

[58] Field of Search ..... 5/13, 464, 465, 475, 5/478, 481, 464, 187, 28, 29, 38, DIG. 2

[56] References Cited

U.S. PATENT DOCUMENTS

| | | | |
|---|---|---|---|
| 2,830,306 | 4/1958 | Wagner et al. | 5/481 X |
| 3,099,021 | 7/1963 | Wetzler | 5/481 X |
| 3,110,043 | 11/1963 | Tyhanic | 5/464 |
| 3,401,411 | 9/1968 | Morrison | 5/481 X |
| 3,459,611 | 8/1969 | Joseph et al. . | |
| 3,665,530 | 5/1972 | Basner | 5/481 X |
| 3,732,586 | 5/1973 | Frey | 5/464 |
| 3,869,739 | 3/1975 | Klein | 5/481 X |
| 3,981,033 | 9/1976 | Toda | 5/475 |
| 4,004,305 | 1/1977 | Rubin . | |
| 4,067,076 | 1/1978 | Krier | 5/475 X |
| 4,116,735 | 9/1978 | Plasse | 5/481 X |
| 4,189,798 | 2/1980 | Vessey | 5/481 X |
| 4,245,363 | 1/1981 | Callaway | 5/475 X |
| 4,286,344 | 9/1981 | Ikeda | 5/475 X |
| 4,389,743 | 6/1983 | Callaway . | |
| 4,398,312 | 8/1983 | Duff | 5/28 X |
| 4,429,427 | 2/1984 | Sklar | 5/475 X |
| 4,476,595 | 10/1984 | Ikeda | 5/478 |
| 4,513,460 | 4/1985 | McIntire | 5/29 X |
| 4,639,952 | 2/1987 | Kensinger | 5/481 X |

FOREIGN PATENT DOCUMENTS

| | | | |
|---|---|---|---|
| 2744412 | 4/1979 | Fed. Rep. of Germany | 5/465 |
| 2910216 | 9/1980 | Fed. Rep. of Germany | 5/475 |
| 8004755 | 3/1982 | Netherlands | 5/481 |

*Primary Examiner*—Alexander Grosz

*Attorney, Agent, or Firm*—King & Schickli

[57] ABSTRACT

A sleeper sofa mattress includes a foam body with an opening for the receipt of a spring assembly. The spring assembly is positioned in the foam body so as to rest between hinge lines that allow the mattress to be folded into the sleeper sofa. A support substrate is attached to the foam body and spring assembly. The support substrate in the form of a high tensile strength polypropylene mesh serves to positively hold the foam body and mattress together and spread the load thereby reducing wear and increasing the comfort and overall service life of the mattress. Insulator pads are also provided across the spring assembly and a cushioning member across the top of the entire mattress completes the combination.

11 Claims, 2 Drawing Sheets

SLEEPER SOFA MATTRESS

BACKGROUND OF THE INVENTION

The present invention relates generally to the sleeper sofa field and, more particularly, to a sleeper sofa mattress providing both increased sitting and sleeping comfort over an extended service life.

Sleeper sofas are well known in the art. A sleeper sofa generally includes a sofa frame and a folding mattress frame and cooperating mattress. A sleeper sofa may be used as a bed by unfolding the mattress frame so as to extend horizontally from the sofa frame. When opened, the mattress rests on and is supported by the extended mattress frame for sleeping. The sleeper sofa may also be used as a conventional sofa by folding the mattress frame and mattress and then sliding them into the sofa frame. Seat cushions are placed on the sofa frame overlying the folded mattress and mattress frame for both improved aesthetics and sitting comfort.

While sleeper sofas have been available for a number of years, certain design problems have not been solved satisfactorily to date. Specifically, since the mattress frame must be able to support at least one and possibly two individuals when extended to form a bed, it must be solid and sturdy. Because of space limitations within the confines of the sofa frame and the requirement of folding capability, possible structural arrangements of the mattress frame components are somewhat limited. As a result, manufacturers have almost universally adopted the use of one or more cross bars extending transversely across the frame to provide the desired rigidity and support.

This solution to the rigidity and support problem unfortunately leads to an additional comfort problem. Specifically, the sleeper sofa mattress must be designed not only to provide firm support for maximum sleeping comfort, but also to prevent the feel of the cross bars through the mattress. Solid foam mattresses are simply incapable of providing the necessary support.

In attempting to reach a solution to the support problem, there are certain design limitations that must be considered and actually conflict with achieving these desired goals. Specifically, like the mattress frame the mattress cannot be bulky since there is only limited space in the sofa frame into which the mattress must fit when the sleeper sofa is closed for sitting. Further, the mattress must be capable of being folded with the mattress frame. Thus, the mattress must allow folding along "hinge lines" extending across the mattress. These factors limit the choice of mattress materials and the design of the mattress that could otherwise increase comfort.

In recent years, a coil spring assembly has been incorporated into a head section of a foam sleeper sofa mattress in order to provide the desired support. While the coil spring assembly does supply added support particularly in the torso region, it is not foldable and, therefore, may only be positioned in the foam mattress between the hinge lines that allow folding.

A problem occurs with this type of design as when the mattress is folded, the foam material tends to separate and pull away from the coil spring assembly. Over time, wear from folding causes the splitting and erosion of the foam mattress materials, particularly along the interface with the spring assembly. Initially, this results in reduced supporting capability. Thus, for example, when sleeping on the mattress the mattress frame cross bar or even the spring assembly itself may be felt pressing uncomfortably through the mattress into the lower back region. As additional time passes, the foam mattress material may actually pull apart from the spring assembly. This results in pronounced and permanent contour irregularities of the mattress surface. In turn, this inevitably leads to having to replace the mattress.

One prior art design that addresses the problem of foam separation from a spring assembly may be r found by reviewing the disclosure of U.S. Pat. No. 4,004,305 to Rubin. In Rubin, the mattress is formed in two sections. Each section includes coil springs supported on a bottom mat and a foam cushion extending upwardly from the mat surrounding the springs. The coil springs increase the support provided by the mattress and, therefore, the sleeping comfort. The service life during which this increased comfort is provided is, however, limited.

As shown in Rubin, the two sections are joined at a hinge line by a simple fabric flap hinge. Not only is support in this area inadequate to start, but it rapidly deteriorates over time. Specifically, with nothing to hold the two sections together at the bottom the repeated folding and unfolding of the mattress causes the bottom margins of the sections to begin to pull apart and separate. This results in the coil springs within the mattress to shift and become oriented at a slight angle to the vertical when loaded. In this position the coil springs fail to provide support as originally designed. Over time, this angular orientation leads to permanent damage through the erosion of the foam cushion adjacent the coil springs and the formation of lumps or contour irregularities in the foam. As a result, it is difficult to find a comfortable position when sleeping on the mattress. Not only can this lead to a substantially sleepless night, but to aches, such as lower back pain, the next morning. Thus, a need is clearly identified for a sleeper sofa mattress capable of providing increased sleeping comfort over a longer service life.

SUMMARY OF THE INVENTION

Accordingly, it is a primary object of the present invention to provide a sleeper sofa mattress overcoming the above-described limitations and disadvantages of the prior art.

Another object of the present invention is the provision of a sleeper sofa mattress providing a better foundation for increased sitting comfort when closed and used as a sofa, and substantially improved sleeping comfort when opened and used as a bed.

An additional object of the present invention is the provision of a mattress for a sleeper sofa furnishing firm support for greater sleeping comfort over an extended service life.

Still another object is to provide a sleeper sofa mattress substantially eliminating the tendency of wear along the interface between a spring assembly and surrounding foam mattress frame, and thus improving the support and comfort provided by the mattress.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved sleeper sofa mattress is provided. The mattress includes a foam frame having a substantially centrally located opening. A spring assembly is positioned within this opening so as to lie between hinge lines of the mattress that allow folding of the mattress into the sleeper sofa frame. A support substrate is attached to the foam frame and the spring assembly. The support substrate extends across the interface between the spring assembly and foam frame so as to hold the foam frame and spring assembly together even when the mattress is folded over. Advantageously, this reduces the adverse effects of wear along the interface that tend to promote pronounced and permanent irregularities in the contours of prior art mattresses. Thus, the comfort and overall service life of the mattress are increased.

Preferably, the mattress also includes an additional cushioning member. This cushioning member, that may also be constructed of foam, is positioned so as to overlie both the foam frame and spring assembly. Advantageously, this cushioning member furnishes added support and comfort to the mattress. The cushioning member effectively serves to spread the firm support provided by the coil spring assembly over a greater surface area so that the entire torso of a sleeper is comfortably supported even above the hinge lines of the mattress and the cross bars of the mattress frame.

In accordance with a further aspect of the present invention, an insulator in the form of a cotton pad is provided over a top face of the spring assembly. The insulator preferably extends across the central opening in the foam frame and is attached to the foam frame by adhesive. A similar insulator pad may be provided extending across the foam frame and the bottom face of the spring assembly. Together, these pads prevent air from circulating from under the mattress frame through the spring assembly. As a result, sleeper comfort is increased.

More specifically, the bottom insulator pad is provided between the foam frame and the support substrate. Like the insulator pad, the support substrate spans the central opening in the foam frame for the spring assembly. The support substrate is fixed to the foam frame with adhesive. Ring locks and/or adhesive is used to fix the support substrate to the spring assembly.

Preferably, the support substrate is formed from polypropylene mesh. Such mesh has the necessary strength to maintain the foam frame and spring assembly together when the mattress is either folded into the sofa or opened and in use as a bed. In this way, the integrity of the interface between the foam frame and spring assembly is maintained and support in the area of the hinge lines is improved. Specifically, the formation of a gap between the spring assembly and foam frame by the pulling back of the foam is prevented. Thus, the coil springs are positively maintained in proper angular orientation by the walls of the surrounding foam frame so as to provide firm support to the torso. Further, this feeling of full, firm support is spread by the overlying cushioning member well past the periphery of the spring assembly. As a result, full support is also provided even along the hinge lines of the mattress and the uncomfortable feeling of any cross members in the folding mattress frame by anyone sleeping on the mattress is substantially eliminated.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and description will be regarded as illustrative in nature and not as restrictive.

BRIEF DESCRIPTION OF THE DRAWING

The accompanying drawing incorporated in and forming a part of the specification illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
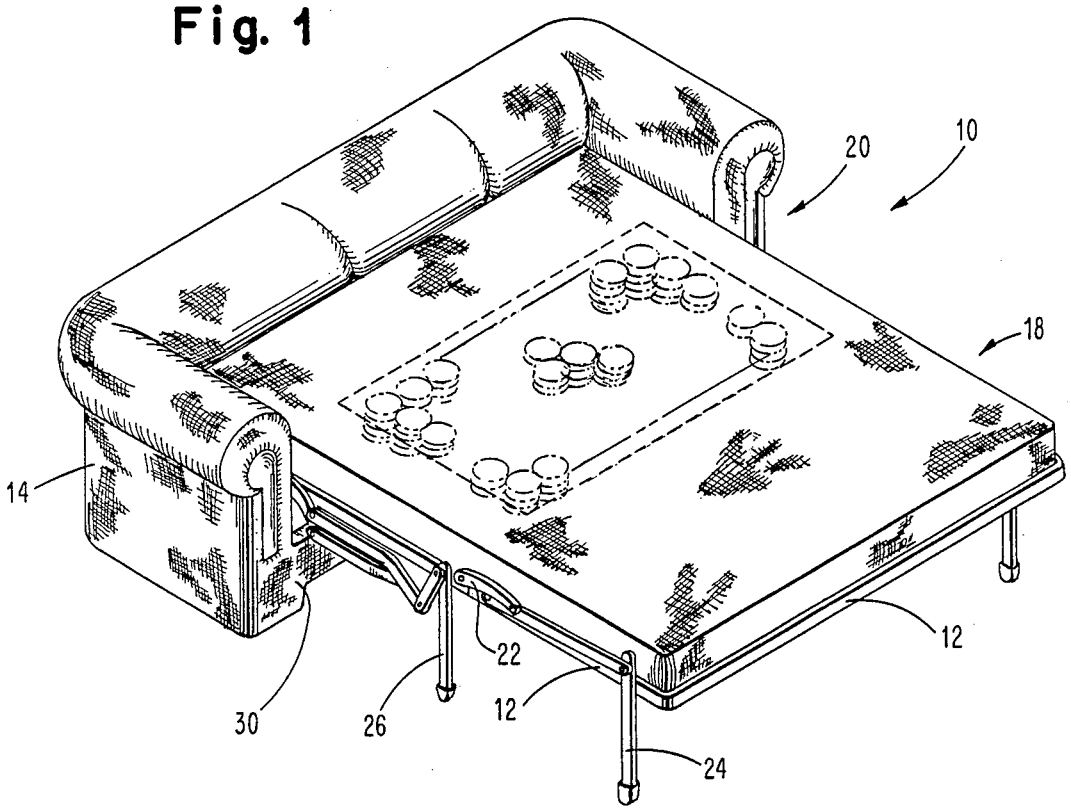
FIG. 1 is a perspective view of a sleeper sofa incorporating the sleeper sofa mattress of the present invention.
Figure 2:
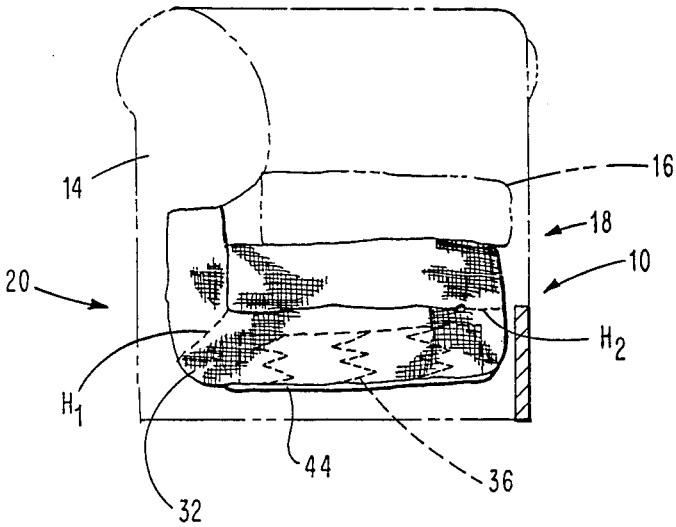
FIG. 2 is a schematical representation of the sleeper sofa with the sleeper sofa mattress folded and the sofa frame closed for sitting.

Reference is now made to FIG. 1 showing the improved sleeper sofa mattress 10 of the present invention. The mattress 10 is supported on a mattress frame 12 by a conventional wire grid 13 (see FIG. 4) extending across the frame, as is known in the art. When opened as shown in FIG. 1, the mattress 10 extends substantially horizontally from the sofa frame 14 to form a bed for sleeping. When closed, as shown in FIG. 2, the mattress 10 and mattress frame 12 are folded into the sleeper sofa frame 14. Cushions 16 are placed over the folded mattress 10 so as to provide an aesthetically pleasing and comfortable sofa for sitting.

Both the mattress frame 12 and the sofa frame 14 are of conventional design and form no part of the present invention. The mattress frame 12 and, therefore, the mattress 10 includes a foot section and a longer head section generally designated by reference numerals 18, 20, respectively. The foot and head sections 18, 20 of the mattress frame 12 are pivotally connected together by a link arm 22. When the mattress frame 12 is opened into the sleeping position shown in FIG. 1, the foot section 18 is supported by a support leg 24 pivotally connected to the foot section of the mattress frame 12. The head section 20 of the mattress frame 12 is supported by a support leg 26 and a parallelogram link mechanism generally designed by reference numeral 28 that is connected to the base members 30 of the sofa frame 14. It is this parallelogram link mechanism 28 that allows the sliding of the folded mattress frame 12 and mattress 10 into the sofa frame 14 as shown in FIG. 2.

Figure 3:
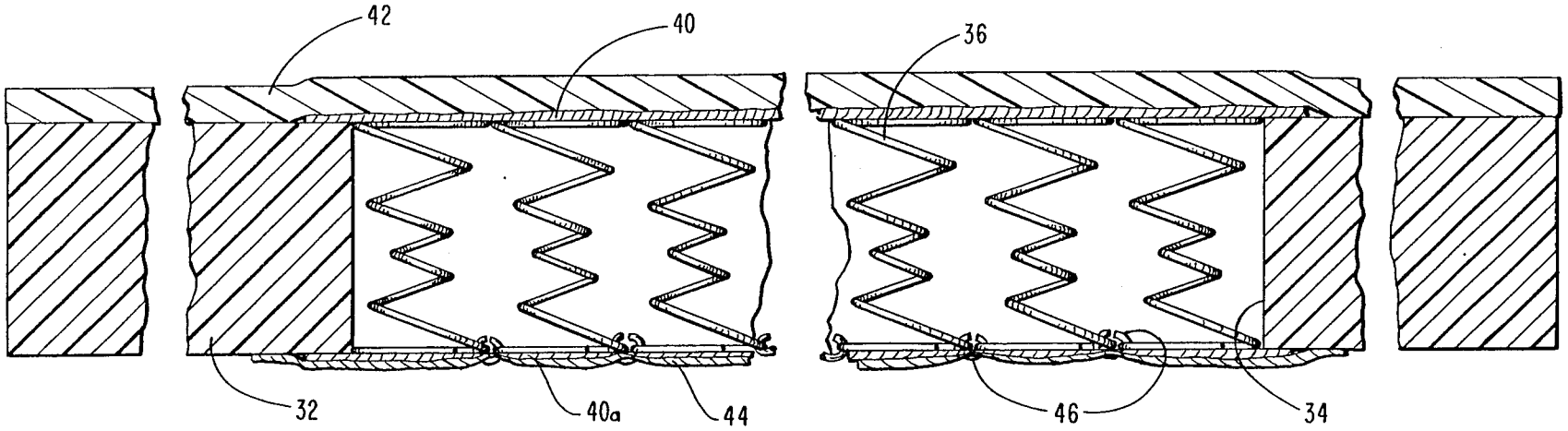
FIG. 3 is an enlarged cross-sectional view of the sleeper sofa mattress of the present invention.

The mattress 10 of the present invention is constructed to furnish more support to the torso when opened for sleeping while still providing exceptional comfort when closed for sitting. The mattress 10 better resists erosion and the formation of irregularities in its contour along hinge lines at which it is folded when closed. This advantageously results in an increased service life over which the mattress 10 continues to exhibit a high level or quality of comfort when sleeping thereon not available with prior art designs. As best shown in FIGS. 1 and 3, the mattress 10 includes a foam body 32. An opening 34 is provided in the foam body 32 for the receipt of a coil spring assembly 36. The spring assembly 36 is inserted in the mattress 10 so as to provide additional support to the torso of any sleeper lying thereon when the mattress is opened (note FIG. 4).

The comfort of the mattress 10 is further enhanced through the provision of insulator pads 40, 40*a* (see FIG. 3), preferably fabricated of cotton cloth. One insulator pad 40 is extended across the top of the opening 34 in the foam body 32 and another pad 40*a* is extended across the bottom of the opening. Each of the pads is fixed to the foam body 32 with adhesive so as to seal the opening 34 and prevent stray air from circulating through the spring assembly 36 and annoying a person sleeping on the mattress.

A foam topper or cushioning member 42 is also provided. The cushioning member 42 overlies both the foam body 32 and the spring assembly 36. Adhesive may be used to secure the cushioning member to the foam body. The cushioning member 42 prevents a person sleeping on the mattress from feeling a sudden change of support in the area where the spring assembly 36 and foam body 32 meet. More particularly, the cushioning member effectively spreads the feeling of the added support provided by the spring assembly 36 over a larger area. Thus, with the spring assembly 36 of the mattress supporting the heaviest part of the body and the cushioning member 42 spreading that additional support over an area beyond the periphery of the spring assembly, the body of the sleeper is more efficiently supported.

Figure 4:
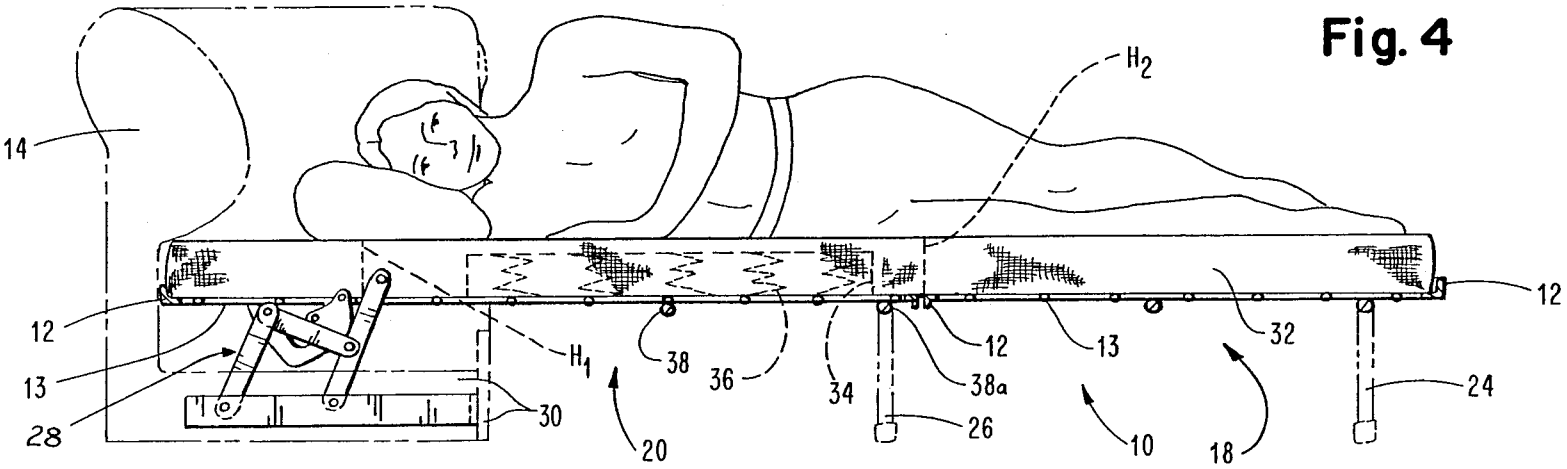
FIG. 4 is a side elevational view of the sofa and, with the mattress frame and folding mechanism broken away, and illustrating the cross members.

With the combination spring assembly 36, pads 40, 40*a* and cushioning member 42 that spreads the load, the sleeper is effectively maintained in a position on the mattress 10 well above the cross bars 38, 38*a* of the mattress frame 12 (see FIG. 4). In this way, the cross bars 38, 38*a* provided to rigidify the mattress frame 12, are not felt extending into the back or hips of the person sleeping on the mattress 10. This is a problem with many previous sleeper sofa designs and past efforts to alleviate this problem have proven unsuccessful. Thus, the greatly enhanced sleeping comfort of the mattress 10 of the present invention fills a long felt need for improvement well recognized in this field.

The improved sleeping qualities of the mattress 10 are maintained over time through the provision of a structure that better resists the formation of irregularities in the contour of the mattress. This is true even along the interface of the foam body 32 and spring assembly 36. As best shown in FIG. 2, the spring assembly 36 is positioned in the foam body 32 of the mattress 10 so as to lie between hinge lines $H_1$, $H_2$. A substrate, in the form of a polypropylene mesh 44, is extended along the bottom of the mattress opening 34 and spring assembly 36. The substrate mesh 44 is secured to the foam body 32 with adhesive and connected to the spring assembly 36 by ring locks 46 (see FIG. 3). The high tensile strength of the mesh 44 insures that the foam body 32 and spring assembly 36 do not pull apart and separate when loaded with a person sleeping thereon or even when folded at the hinge lines $H_1$, $H_2$ and positioned within the sofa frame 14 for extended periods of time. Thus, the integrity of the original mattress construction is maintained for lasting sleeping comfort and the formation of irregularities in the contour of the mattress through the erosion of the foam adjacent the spring assembly 36 is substantially eliminated.

It should also be recognized that when closed as shown in FIG. 2, the mattress 10 provides enhanced sitting comfort as well. Specifically, the cushion 16 provides relatively soft support as desired for more comfortable sitting. The level of support is then gradually increased in layers through the underlying solid foam mattress foot section 18, providing an intermediate level of support, and finally the relatively firm spring assembly 36.

In summary, numerous benefits have been described which result from employing the concepts of the present invention. The mattress 10 of the present invention includes a coil spring assembly 36 to provide firm support to the torso. Advantageously, the spring assembly 36 cooperates with an overlying cushioning member 42 so as to further increase overall sleeping comfort. Together they serve to provide a feeling of additional support across the mattress hinge lines $H_1$ and $H_2$ and eliminate the uncomfortable feeling of any cross members of the mattress frame extending into the back when sleeping on the mattress. A polypropylene mesh substrate 44 maintains the integrity of the mattress construction. The substrate mesh 44 prevents the foam body 32 from pulling apart and separating from the spring assembly 36 at any time. Consequently, the mattress is less susceptible to the formation of pronounced and permanent irregularities in the contour of the mattress surface. Thus, the present mattress provides enhanced comfort as well as a longer service life.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A mattress for a sleeper sofa, including a sofa frame and folding mattress frame selectively positionable between a folded position for sitting and an extended position for sleeping comprising:

a substantially continous foam body including a substantially central opening between hinge lines extending through said foam body that allow folding of said mattress on said mattress frame into said sleeper sofa frame;

a spring assembly positioned within said central opening; and a support substrate securely attached to said foam body and said spring assembly, said support substrate being formed from polypropylene mesh having relatively high tensile strength to resist separating of said foam body and said spring assembly, said support substrate positively holding the foam body an spring assembly together whether in the folded or extended positions to thereby increase the comfort and overall service life of the mattress.

2. The mattress recited in claim 1, further including a cushioning member, said cushioning member overlying both said foam body and spring assembly to provide added support and comfort.

3. The mattress recited in claim 1, wherein an upper insulator is provided over a top face of said spring assembly.

4. The mattress recited in claim 3, wherein said insulator extends across said opening in said foam body and is attached to said foam body.

5. The mattress recited in claim 1, wherein a lower insulator is provided extending across said opening in said foam body along a bottom face of said spring assembly.

6. The mattress recited in claim 5, wherein said lower insulator is attached to said foam body by adhesive.

7. The mattress recited in claim 5, wherein said lower insulator is provided between said foam body and said support substrate.

8. The mattress recited in claim 1, wherein said support substrate spans said opening in said foam body for said spring assembly.

9. The mattress recited in claim 8, wherein said support substrate is fixed to said foam body with adhesive.

10. The mattress recited in claim 8, further including ring locks to fix said support substrate to said spring assembly.

11. The mattress recited in claim 8, wherein said support substrate is fixed to said spring assembly with adhesive.

* * * * *